US008246118B2

(12) United States Patent
Moore

(10) Patent No.: US 8,246,118 B2
(45) Date of Patent: Aug. 21, 2012

(54) ADJUSTABLE FOOTREST FOR STOOL OR PEDESTAL CHAIR

(76) Inventor: Curtis E. Moore, Kingston, TN (US)

( * ) Notice: Subject to any disclaimer, the term of this patent is extended or adjusted under 35 U.S.C. 154(b) by 182 days.

(21) Appl. No.: 12/701,954

(22) Filed: Feb. 8, 2010

(65) Prior Publication Data

US 2010/0201177 A1 Aug. 12, 2010

Related U.S. Application Data

(60) Provisional application No. 61/151,626, filed on Feb. 11, 2009.

(51) Int. Cl.
*A47C 7/50* (2006.01)

(52) U.S. Cl. ..... 297/423.25; 297/423.1; 297/423.24

(58) Field of Classification Search ..... 297/423.1, 297/423.12, 423.25, 423.26, 423.4
See application file for complete search history.

(56) References Cited

U.S. PATENT DOCUMENTS 801,398 A * 10/1905 Ray ..... 297/423.4
2,008,689 A * 7/1935 Donahoe ..... 297/423.1
3,151,910 A 10/1964 Larson
3,642,320 A 2/1972 Ward
3,820,844 A 6/1974 Fortnam
3,891,270 A 6/1975 Crossman et al.
3,961,822 A * 6/1976 Daniel ..... 297/423.1
4,008,500 A 2/1977 Hall, Jr.
4,086,676 A 5/1978 Arruza
4,148,524 A 4/1979 Guyton
4,278,289 A 7/1981 Esposito
4,425,863 A 1/1984 Cutler
4,460,216 A 7/1984 Keller
4,753,407 A 6/1988 Brock
4,879,963 A 11/1989 Dionne
5,458,399 A 10/1995 Gezari et al.
5,795,017 A 8/1998 Zimmerman et al.
5,937,564 A 8/1999 Perreault
6,012,775 A 1/2000 Czarnecki
6,584,926 B1 7/2003 Schmitt et al.
6,808,231 B1 10/2004 Hill
7,445,291 B2 * 11/2008 Parkel et al. ..... 297/423.1
7,452,034 B2 * 11/2008 Jung ..... 297/423.1 X
2005/0126064 A1 6/2005 Winkler

* cited by examiner

*Primary Examiner* — Anthony D Barfield
(74) *Attorney, Agent, or Firm* — Luedeka Neely Group, P.C.

(57) ABSTRACT

A footrest for a foot of a person is provided, where the person is at least partially supported by a seat that is disposed on a stand that has a support post or disposed on a shaft that is part of a pedestal support assembly. Typically the footrest has a plate with a footrest surface and in some embodiments the footrest surface is entirely under the seat. In some embodiments the footrest surface faces away from the support post or shaft. Some embodiments include a mounting bracket and a connecting assembly that operatively secures the footrest plate to the mounting bracket. The connecting assembly generally has two engagement mechanisms and a spring that biases the connecting assembly in selectable angular positions with respect to the mounting bracket and plate.

8 Claims, 3 Drawing Sheets

ADJUSTABLE FOOTREST FOR STOOL OR PEDESTAL CHAIR

CROSS REFERENCES TO RELATED APPLICATIONS

This patent application claims priority from and is related to U.S. Provisional Patent Application No. 61/151,626 filed Feb. 11, 2009, entitled, "Adjustable Footrest for Stool or Pedestal Chair." Provisional Patent Application No. 61/151,626 is incorporated by reference in its entirety herein.

FIELD

This disclosure relates to the field of footrests for chairs. More particularly, this disclosure relates to adjustable footrests for stools or pedestal chairs.

BACKGROUND

Various chairs are designed for use in activities that involve movement of the user. Examples are pedestal chairs for fishermen and stools for persons working at service counters. In such applications the user of the chair or stool frequently desires to change positions in the seat of the chair or desires to move off or onto the chair. Also many users in an active environment desire to simply rest against the chair rather than fully sit on the seat of the chair. Often in an active environment it is physically helpful and desirable to rest one's foot on a support structure in order to reduce muscle strain and fatigue. Various footrests have been designed for chairs, but typically the prior designs are not adequately adjustable to meet the needs of users. Also, prior footrest designs are often configured in ways that impede the mobility of a person using the chair in an active environment. What are needed therefore are improved configurations of footrests for chairs that are designed more beneficially for use in activities that involve frequent movement of the user.

SUMMARY

In one embodiment the present disclosure provides a footrest for a foot of a person who is at least partially supported by a seat disposed on at least one support post. In this embodiment the footrest includes a plate that is operatively secured to the at least one support post. The plate has a deployed configuration and has a footrest surface that is configured for at least partially supporting the foot of the person in the deployed configuration of the plate. In the deployed configuration of the plate, the footrest surface is disposed entirely under the seat. In some versions of this embodiment the plate is specifically secured to a single support post.

A further embodiment provides a footrest for a foot of a person who is at least partially supported by a seat disposed on a pedestal support assembly. In this embodiment the pedestal support assembly has a single shaft and a base assembly with a top surface. The footrest includes a plate that is operatively secured to the single shaft. The plate has a deployed configuration and has a footrest surface that is configured for at least partially supporting the foot of the person in the deployed configuration of the plate. In the deployed configuration of the plate the plate is entirely separated from the top surface of the base assembly, and a substantial portion of the footrest surface faces away from the single shaft. In some versions of this embodiment, when the plate is in the deployed configuration, the footrest surface is disposed entirely under the seat.

A further embodiment provides a footrest for a foot of a person who is at least partially supported by a seat disposed on at least one support post. In this embodiment the footrest includes a mounting bracket that is operatively secured to the at least one support post. There is a brace that has a deployed configuration and the brace has a footrest surface that is configured for at least partially supporting the foot of the person in the deployed configuration of the brace. Further provided in this embodiment is a connecting assembly that has (a) a first engagement mechanism configured to releasably secure the connecting assembly to the mounting bracket in a plurality of bracket angle positions, and (b) a second engagement mechanism configured to releasably secure the connecting assembly to the brace in a plurality of brace angle positions. This embodiment also includes a biasing system that is configured to (i) bias the first engagement mechanism in a first position selected from the plurality of bracket angle positions and (ii) bias the second engagement mechanism in a second position selected from the plurality of brace angle positions. In some versions of this embodiment the mounting bracket is specifically secured to a single support post. In some versions of this embodiment the biasing system includes a spring assembly that is configured to (a) provide a first force configured to bias the first engagement mechanism and (b) configured to provide a second force vectored away from the first force and configured to bias the second engagement mechanism. In some versions of this embodiment, in the deployed configuration of the brace, the footrest surface is disposed entirely under the seat.

In various embodiments of a footrest having a brace with a footrest surface, the brace typically has a plurality of adjustable configurations and in every adjustable configuration of the brace the footrest surface is disposed entirely under the seat. In various embodiments the brace has a stowed configuration and in the stowed configuration substantially the entire footrest surface is disposed substantially parallel to a support post or a shaft supporting a seat. In various embodiments the footrest surface has a split shoulder. In various embodiments the footrest surface has a surface area smaller than approximately thirty-six square inches. In various embodiments the footrest is configured for use by a person who is at least partially supported by a standard seat.

BRIEF DESCRIPTION OF THE DRAWINGS

Various advantages are apparent by reference to the detailed description in conjunction with the figures, wherein elements are not to scale so as to more clearly show the details, wherein like reference numbers indicate like elements throughout the several views, and wherein.

DETAILED DESCRIPTION

In the following detailed description of the preferred embodiments, reference is made to the accompanying drawings, which form a part hereof, and within which are shown by way of illustration the practice of specific embodiments of a footrest for a foot of a person who is at least partially supported by a seat disposed on a stand that has at least one support post, and embodiments of a footrest for a foot of a person who is at least partially supported by a seat disposed on a pedestal support assembly. It is to be understood that other embodiments may be utilized, and that structural changes may be made and processes may vary in other embodiments.

The availability of a footrest to support a foot of a person in an active environment is an important element for reducing muscle strain and fatigue. This is particularly true in environments where the person is standing much of the time and only resting against the seat of the chair. An example of such an application is for fisherman who typically fish from the front of a boat and rest against a pedestal seat. In such environments a footrest, even one sized to support just one foot of the user, improves circulation and helps relax back muscles. However, it is very important that the footrest not interfere with the mobility of a user in an environment such as fishing, where the user must be able to quickly move around the chair without stumbling over the footrest.

Figure 1:
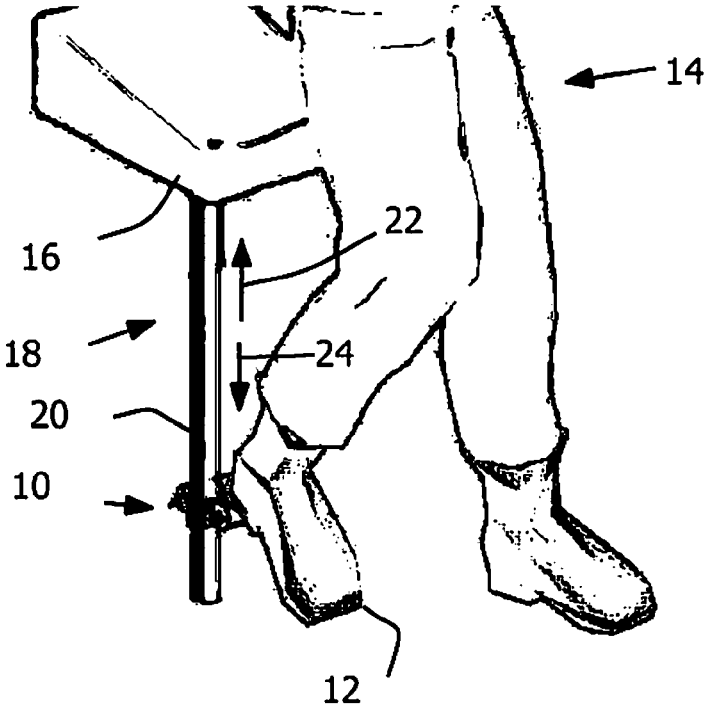
FIG. 1 is a perspective view of a person using a footrest.

FIG. 1 illustrates a footrest 10 for supporting the foot 12 of a person 14 in an active environment. The person 14 is leaning against a seat 16 of a pedestal chair 18. In this embodiment the person is standing near the pedestal chair 18 and is leaning against the seat 16 so that the person 14 is partially supported by the seat 16. In other embodiments the person 14 may be seated on the seat 16 such that the person 14 is substantially entirely supported by the seat 16, and in such embodiments the person 14 may still have a foot 12 supported by the footrest 10. In the embodiment of FIG. 1 the seat 16 of the pedestal chair 18 is disposed on a support post 20.

For some referential purposes herein the term "vertical" is used to describe an orientation that is substantially parallel to the support post 20 and the term "horizontal" is used to describe an orientation that is orthogonal to the support post 20. The term "up" refers to the direction 22 and the term "down" refers to the direction 24 depicted in FIG. 1. When a first element is referred to as being "above" a second element the first element is disposed in the direction 22 with respect to the second element, and when a first element is referred to as being "below" or "under" a second element the first element is disposed in the direction 24 with respect to the second element.

Figure 2:
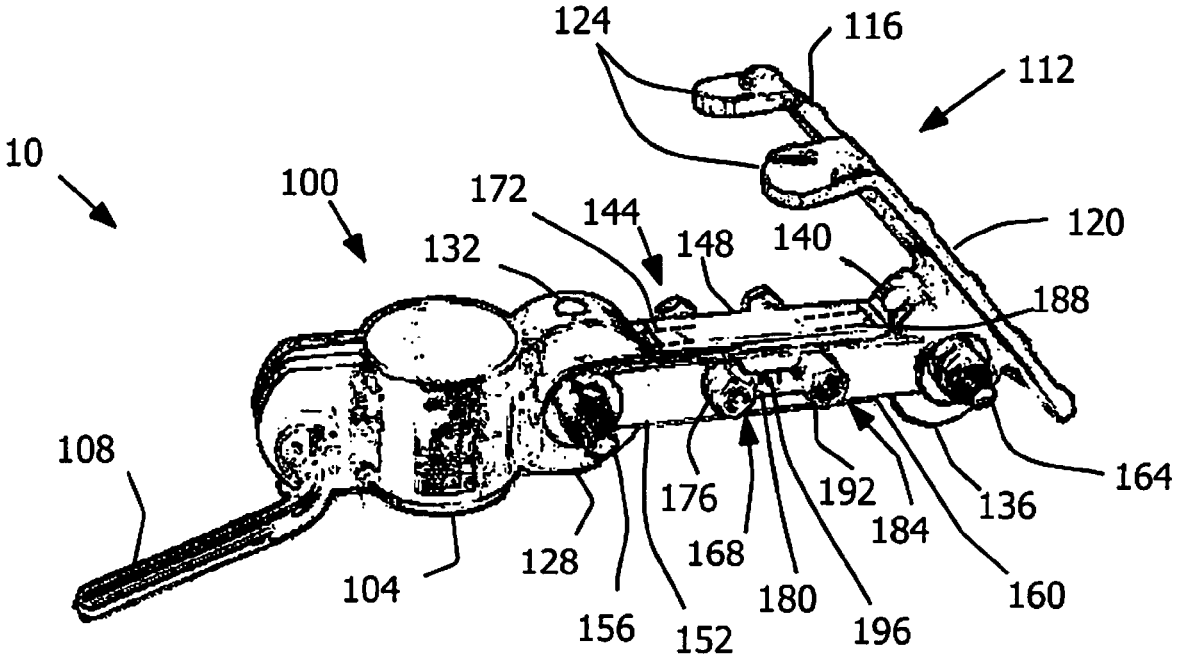
FIGS. 2-5 are perspective views of an embodiment of a footrest.

FIG. 2 depicts details of an embodiment of the footrest 10. The footrest 10 has a mounting bracket assembly 100 that is configured for mounting the footrest 10 on a vertical shaft or a support post such as the support post 20 depicted in FIG. 1. The mounting bracket assembly 100 includes a collar 104 and a tightening handle 108 that are configured to movably position the footrest 10 on a vertical support post or shaft. In other embodiments the mounting bracket may be configured to movably position a footrest on a horizontal or other-angled member of a chair.

The footrest 10 also has a brace 112 that includes a plate 116 with a footrest support surface 120. A "brace" (as the term is used herein) refers to an element that may include a rod or a tube or a plate as a component for supporting the foot of a person. The term "plate" as used herein refers to the usual sense of the word, meaning an element that has surface area that is broad in two dimensions compared with a relatively thin dimension in the direction that is orthogonal to the broader surface area. Typically a plate has a flat planar footrest support surface, but in some embodiments the footrest support surface of a plate may be curved. Also, as indicated in FIG. 1, a footrest support surface (e.g. 120) of a plate (e.g., 116) may have one or more angled extensions, such as a split shoulder 124. The term "plate" as used herein excludes rods and tubes. When a rod or tube is used as a component of a brace for supporting the foot of a person, the corresponding footrest support surface may be flat, polygonal or round. A plate is preferred over a rod or tube for providing a footrest support surface in a brace because a plate is generally more comfortable for a person using the footrest.

To help prevent the footrest from interfering with the mobility of the user, it is helpful to minimize the size of the footrest, which to a large extent favors minimizing the surface area of the footrest support surface. It has been discovered that a footrest support surface of about thirty-six square inches or less is adequate to support one foot of a user, and that size provides minimal interference with the movement of the user. In some embodiments a footrest support surface of about twenty-four square inches or less may be used. In some embodiments a footrest support surface of about eighteen square inches or less may be used. For example, a plate 116 may have dimensions (excluding the split shoulder 124) of approximately five and seven-eighths inches by two and seven-eighths inches. In most embodiments a footrest support surface of at least three square inches is used.

Continuing with FIG. 2, the mounting bracket assembly 100 has a bracket sprocket 128 attached to the collar 104, and the bracket sprocket 128 has a series of bracket indents 132 that are used to adjust the configuration of the footrest 10. The brace 112 includes a brace sprocket 136 that is attached to the plate 116, and the brace sprocket 136 has a series of brace indents 140 that are used to adjust the configuration of the footrest 10.

The footrest 10 also includes a connecting assembly 144. The connecting assembly 144 connects the mounting bracket assembly 100 of the footrest 10 to the brace 112 of the footrest 10. In this embodiment the connecting assembly 144 employs a hollow square tubular member 148. In some embodiments the tubular member 148 may be fabricated as a round tubular member. In some embodiments a solid member may be used in place of the tubular member 148. The tubular member 148 has a first pair of flanges 152 (only one of which is visible in FIG. 2) that attach the tubular member 148 to the bracket sprocket 128 of the mounting bracket assembly 100, using a first fastener assembly 156. The tubular member 148 also has a second pair of flanges 160 (only one of which is visible in FIG. 2) that attach the tubular member 148 to the brace sprocket 136 of the brace 112 using a second fastener assembly 164.

The connecting assembly 144 further includes a first engagement mechanism 168 that is configured to variably secure the connecting assembly 144 to the mounting bracket assembly 100 in a plurality of bracket angle positions. The first engagement mechanism 168 is a "T"-shaped element. The "stem" part of the "T" is a first rod 172 (shown as hidden in this view) that engages a selected bracket indent 132 of the bracket sprocket 128. The "crossing" part of the "T"-shaped first engagement mechanism 168 is a first bolt assembly 176 that is attached to the first rod 172. The first engagement mechanism 168 is configured to move laterally in a pair of channels 180 that are formed in the tubular member 148, such that by moving the first bolt assembly 176 along the channels 180 the rod portion of the first engagement mechanism 168 may selectively engage with and disengage from the bracket indents 132 in the bracket sprocket 128.

The connecting assembly 144 further has a second engagement mechanism 184 that is configured to variably secure the connecting assembly 144 to the brace 112 in a plurality of brace angle positions. The second engagement mechanism 184 is a "T"-shaped element with the "stem" part of the "T" being a second rod 188 (also shown as hidden in this view) that engages a selected brace indent 140 of the brace sprocket 136 and the "crossing" part of the "T" being a second bolt assembly 192 that is attached to the second rod 188 and that is configured to move laterally in the channels 180 that are formed in the tubular member 148. By moving the second bolt assembly 192 along the channels 180 the rod portion of the second engagement mechanism 184 may selectively engage with and disengage from the bracket indents 140 in the brace sprocket 136. In some embodiments pins may be substituted for the first bolt assembly 176 and the second bold assembly 192, where the pins have circumferential grooves that are formed on opposing ends of the pins adjacent the flanges 160, and a fastener such as an "E" clip or a snap ring is disposed in each groove to hold each pin in place.

The first engagement mechanism 168 and the second engagement mechanism 184 are biased apart by a spring assembly 196 that is disposed in the tubular member 148 between the first engagement mechanism 168 and the second engagement mechanism 184. Typically the spring assembly 196 is a single (one) compression coil spring. In the configuration of FIG. 2 the spring assembly 196 is configured to (a) provide a first force configured to bias the first engagement mechanism 168 in a first position selected from the plurality of bracket angle positions, and (b) configured to provide a second force vectored away from the first force and configured to bias the second engagement mechanism in a second position selected from the plurality of brace angle positions.

To adjust the angular position of the connecting assembly 144 with respect to the mounting bracket assembly 100, the first engagement mechanism 168 is first moved toward the second engagement mechanism 184, pressing against the spring assembly 196, and disengages the first engagement mechanism 168 from an indent 132 in the bracket sprocket 128. The tubular member 148 is then rotated around the first fastener assembly 156 and the pressure on the first engagement mechanism 168 against the spring assembly 180 is relaxed, allowing the first engagement mechanism 168 to engage a different indent 132 in the bracket sprocket 128. The angular position between the connecting assembly 144 with respect to the brace 112 is adjusted in a similar manner, by moving the second engagement mechanism 184 toward the first engagement mechanism 168, rotating the brace 112, and engaging the second engagement mechanism 184 in a different indent 128 in the brace sprocket 136. Thus the angle and position of the brace 112 with respect to the mounting bracket assembly 100 may be adjusted in a plurality of deployed configurations to accommodate the needs of the person 14 using the footrest 10, as illustrated in FIGS. 3, 4, and 5.

Figure 3:
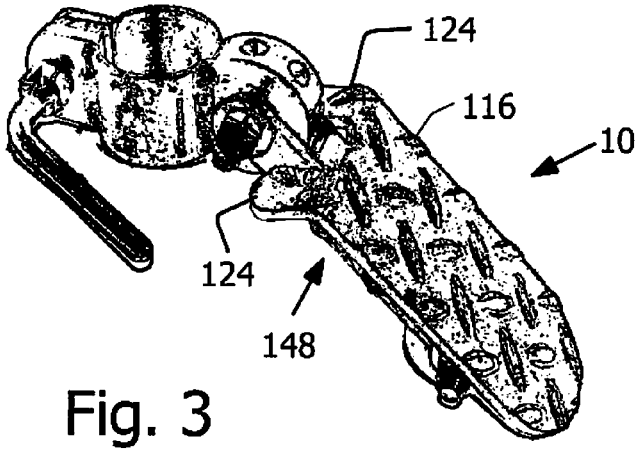

FIG. 3 illustrates a benefit of the split shoulder 124 compared with a full shoulder that might be used across the top of the plate 116. The gap between the two portions of the split shoulder 124 permits the substantial area of the plate 116 to be positioned adjacent and parallel to the tubular member 148, which provides a compact design.

Figure 4:
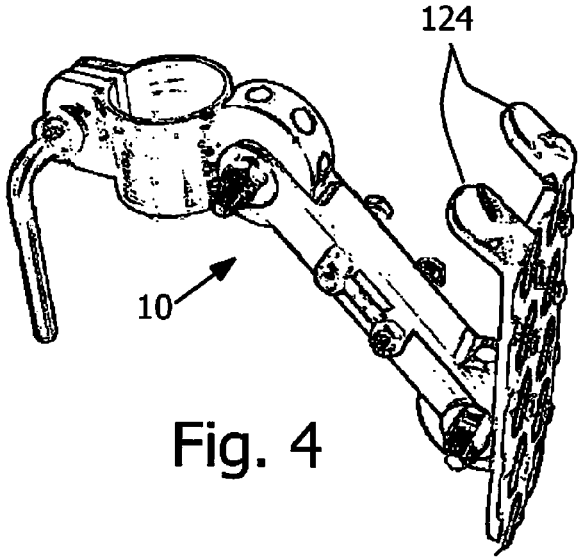

FIG. 4 illustrates a further benefit of the split shoulder 124. The separate portions of the split shoulder 124 provide tabs that may prevent the heel of a shoe from catching on the upper edge of the plate 116 and impairing the movement of the a person when the person desires to remove his or her foot from the brace 112.

Figure 5:
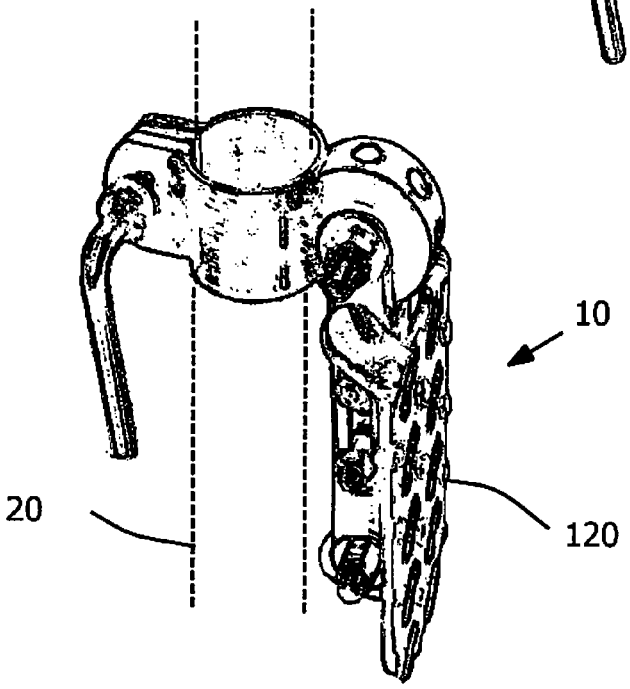

FIG. 5 illustrates a stowed configuration of the footrest 10. The footrest 10 is configured such that in the stowed configuration substantially the entire footrest support surface 120 may be disposed substantially parallel to a support post (e.g., support post 20).

Figure 6:
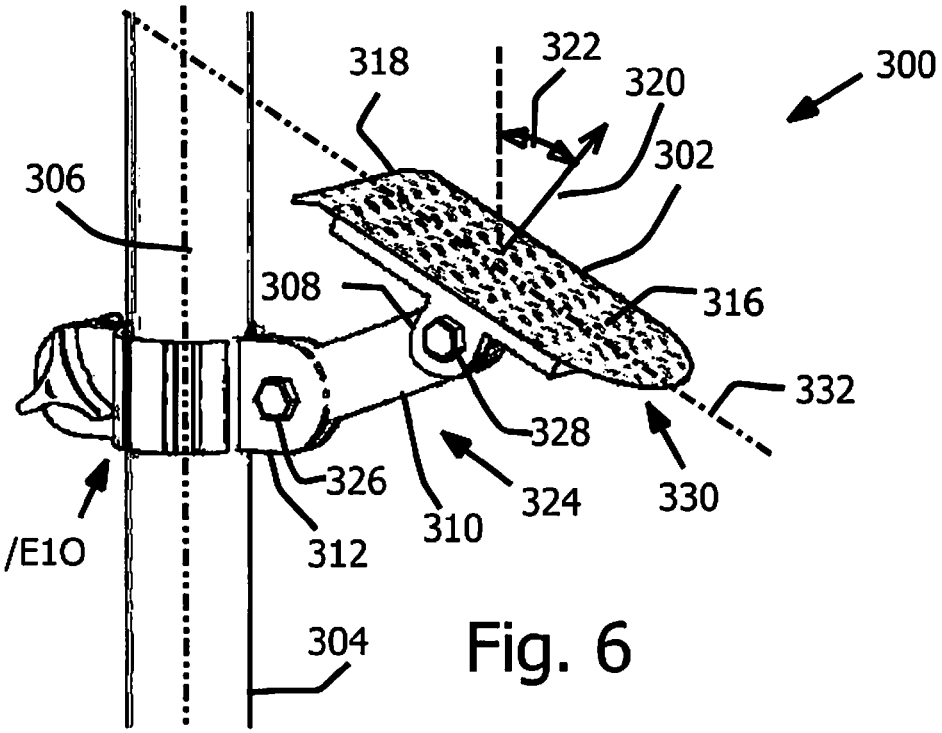
FIG. 6 is a perspective view of an embodiment of a footrest installed on a support post.

FIG. 6 illustrates a further embodiment of a footrest 300. In this embodiment a plate 302 is operatively secured to a single shaft 304 having an axis 306. As used herein, the term "operatively secured" refers to an arrangement of the recited elements that establishes a structural connection between the recited elements, either by direct attachment of the elements together or by connection of the recited elements through one or more intervening elements. For example, in the embodiment of FIG. 6, the plate 302 is "operatively secured" to the single shaft 304 by a first flange 308, a connector rod 310, and a second flange 312 and a mounting bracket 314.

FIG. 6 illustrates several other features of some embodiments of a footrest. For example, the plate 302 of the footrest 300 has a footrest surface 316. A footrest surface (e.g., footrest surface 316) is a broad area of a plate (e.g., plate 302) that is configured to support the sole of a shoe of a person who is at least partially supported by a seat. A substantial portion (the portion excluding the shoulder 318) of the footrest surface 316 has a facing direction depicted by arrow 320. Arrow 320 is perpendicular to the substantial portion of the footrest surface 316. The substantial portion of the footrest surface 316 faces away from the support post by angle 322, which in FIG. 6 is about 30°. In some embodiments the angle 322 may be within a range from about 30° to about 150°. In some embodiments the angle 322 may be within a range from about 30° to about 90°. When angle 322 is within a range from about 10° to about 170°, the substantial portion of the footrest surface 316 is said to face away from the support post. Also, the footrest surface 316 has a longitudinal ray 332. A "longitudinal ray" refers herein to an extension of a line on the footrest surface 316 that is parallel to the longitudinal axis. The longitudinal axis of the footrest surface 316 is a line that is parallel to the lengthwise dimension of the footrest and that bisects the width of the footrest surface 316. In the embodiment of FIG. 6 the longitudinal axis of the footrest surface 316 is coincident with longitudinal ray 332 that is depicted there. In this embodiment the longitudinal ray 332 of the footrest surface 316 intersects the axis 306 of the single shaft 304. Having a longitudinal ray (e.g., 332) intersect the axis 306 of the single shaft 304 is beneficial because it provides a stable support surface.

FIG. 6 also illustrates a further embodiment of some connecting assemblies. The connecting assembly 324 includes the connector rod 310 and a first bolt 326 and a second bolt 328. The bolt/flange combinations 326/312 and 328/308 are further examples of engagement mechanisms that (respectively) are configured (1) to variably secure a connecting assembly (e.g., 324) to a mounting bracket (e.g., 314) and (2) to variably secure a connecting assembly (e.g., 324) to a brace (e.g., 330). The bolts 326 and 328 are further examples of a biasing system configured to (i) bias a first engagement mechanism in a first position selected from a plurality of bracket angle positions and (ii) bias a second engagement mechanism in a second position selected from a plurality of brace angle positions. The interfacing surfaces of the connector rod 310 and the flanges 308 and 312 may be serrated or knurled to improve the resistance of the footrest surface 316 to inadvertent movement when a person rests a foot on the footrest surface 316.

Figure 7:
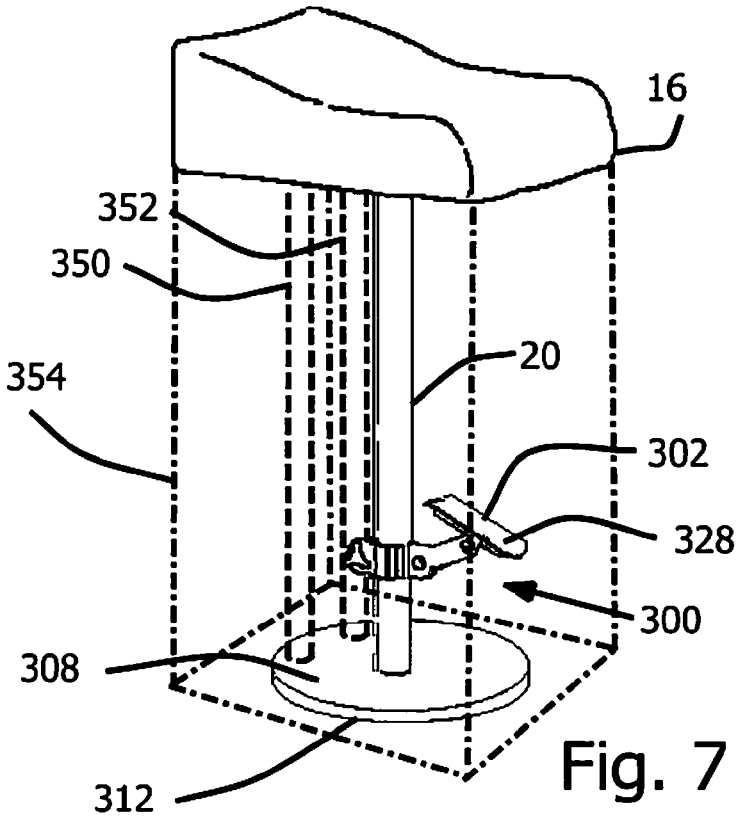
FIG. 7 is a perspective view of an embodiment of a footrest installed on a support post and a seat disposed on the support post.

FIG. 7 depicts various features of some embodiments, illustrating here a footrest 300 with a plate 302 in a deployed configuration. The plate 302 has a footrest surface 328. A seat 16 is supported by a support post 20. Some embodiments may include a plurality of support posts such as support posts 20, 350 and 352. In embodiments that employ three support posts (e.g., 20, 350, and 352 as depicted in FIG. 7), the plate 328 is said to be "specifically secured" to post 20. As used herein, the recitation of a first element that is "specifically secured" to a second element refers to an arrangement of a first element and a single instance of a plurality of the second elements that establishes a structural connection between the first element and only one of the plurality of second elements, other than a structural connection of the first element to other potential second elements that occurs only through the one "directly secured" second element. For example, the plate 302 is "operatively secured" to support post 350 and support post 352 because the plate 302 is structurally connected to support post 350 and support post 352 through the base assembly 312 and through the seat 16. However the plate 302 is "specifically secured" only to support post 20 because support post 20 is a single instance of a plurality of support posts (20, 350, and 352) and the structural connection to the other support posts 350 and 352 occurs through support post 20.

Continuing with FIG. 7, some embodiments may include a base assembly 312 having a top surface 308. The base assembly 312 is used to mechanically stabilize the support post(s) (e.g., 20, 350, and 352). In some embodiments the support post(s) (e.g., 20, 350, and 352) may be directly secured to a floor surface and in such embodiments the floor surface is considered herein to be a "base assembly." In the configuration of FIG. 7 the plate 302 is entirely separated from the top surface 308 of the base assembly 312. Also a space that is characterized as "under" the seat 16 is defined by the phantom box 354 that is vertical projection of the top view of the seat 16. In the embodiment of FIG. 7 the footrest surface 328 is characterized as "disposed entirely under" the seat 16 because the footrest surface 328 is entirely within phantom box 354. A "standard seat" is approximately eighteen inches in diameter (if the seat is circular) or approximately eighteen inches wide by eighteen inches long (if the seat is polygonal). A standard seat is also disposed on a pedestal support assembly having a single shaft. Consequently, a footrest (e.g., footrest 300) is configured to be disposed entirely under a standard seat if in a deployed configuration of no part of the footrest surface (e.g., footrest surface 328) projects more than approximately nine inches from the axis of its collar (e.g., collar 104 depicted in FIG. 2).

In summary, various embodiments of footrests are disclosed herein. The foregoing descriptions of embodiments have been presented for purposes of illustration and exposition. They are not intended to be exhaustive or to limit the embodiments to the precise forms disclosed. Obvious modifications or variations are possible in light of the above teachings. The embodiments are chosen and described in an effort to provide the best illustrations of principles and practical applications, and to thereby enable one of ordinary skill in the art to utilize the various embodiments as described and with various modifications as are suited to the particular use contemplated. All such modifications and variations are within the scope of the appended claims when interpreted in accordance with the breadth to which they are fairly, legally, and equitably entitled.

What is claimed is:

1. A footrest for a foot of a person who is at least partially supported by a seat disposed on at least one support post, comprising:

a mounting bracket operatively secured to the at least one support post;

a brace having a deployed configuration and having a footrest surface configured for at least partially supporting the foot of the person in the deployed configuration of the brace; and a connecting assembly comprising (a) a first engagement mechanism configured to variably secure the connecting assembly to the mounting bracket in a plurality of bracket angle positions, (b) a second engagement mechanism configured to variably secure the connecting assembly to the brace in a plurality of brace angle positions, and (c) a biasing system configured to (i) bias the first engagement mechanism in a first position selected from the plurality of bracket angle positions and (ii) bias the second engagement mechanism in a second position selected from the plurality of brace angle positions.

2. The footrest of claim 1 wherein the mounting bracket is directly secured to a single support post.

3. The footrest of claim 1 wherein the biasing system comprises a spring assembly configured to (a) provide a first force configured to bias the first engagement mechanism and (b) configured to provide a second force vectored away from the first force and configured to bias the second engagement mechanism.

4. The footrest of claim 1 where in the deployed configuration of the brace the footrest surface is disposed entirely under the seat.

5. The footrest of claim 1 wherein the brace has a stowed configuration and substantially the entire footrest surface is disposed substantially parallel to the at least one support post in the stowed configuration.

6. The footrest of claim 1 wherein the brace has a plurality of adjustable configurations and in every adjustable configuration of the brace the footrest surface is disposed entirely under the seat.

7. The footrest of claim 1 wherein the footrest surface comprises a split shoulder.

8. The footrest of claim 1 wherein the footrest surface is a flat planar surface.

* * * * *